US005850065A

United States Patent [19]

Yaginuma et al.

[11] Patent Number: 5,850,065

[45] Date of Patent: Dec. 15, 1998

[54] GAS CIRCUIT BREAKER

[75] Inventors: Noriyuki Yaginuma; Masanori Tsukushi, both of Hitachi; Makoto Yano, Mito; Katsuhiko Shiraishi, Hitachi; Youichi Ohshita, Hitachinaka, all of Japan

[73] Assignee: Hitachi, Ltd., Tokyo, Japan

[21] Appl. No.: 782,269

[22] Filed: Jan. 15, 1997

[30] Foreign Application Priority Data

Feb. 22, 1996 [JP] Japan ..... 8-034744

[51] Int. Cl.[6] ..... H01H 33/72

[52] U.S. Cl. ..... 218/76; 218/43; 218/46

[58] Field of Search ..... 218/43–47, 51–53, 218/56, 57, 66, 68, 72, 75–78, 81, 83, 85, 89, 61, 59, 155–157

[56] References Cited

U.S. PATENT DOCUMENTS

| | | | |
|---|---|---|---|
| 3,814,883 | 6/1974 | Milianowicz | 200/148 G |
| 4,009,358 | 2/1977 | Gratzmuller | 200/150 B |
| 4,516,006 | 5/1985 | Kobayashi et al. | 200/148 A |
| 4,749,831 | 6/1988 | Hosomi et al. | 200/148 A |
| 5,025,118 | 6/1991 | Meinherz et al. | 200/148 R |
| 5,387,773 | 2/1995 | Nakajima et al. | 200/148 A |

*Primary Examiner*—Michael A. Friedhofer
*Attorney, Agent, or Firm*—Fay, Sharpe, Beall, Fagan, Minnich & McKee

[57] ABSTRACT

A dielectric gas produced at the time of current interruption is exhausted into an exhaust structure 1 through an opening 8 formed on a fixed-side support member 6 combined with a fixed arcing contact 4. The exhaust structure 1 has an enlarged portion with a gas flow cross section formed at least before a position at ½ of the overall length of the exhaust structure 1 that is uniformly enlarged toward the rear of the exhaust structure 1 with respect to the joint between the exhaust tube 1 and the fixed-side support member 6. As a result, the gas is immediately exhausted into the exhaust structure 1 and the interelectrode insulation recovery performance is ensured.

12 Claims, 4 Drawing Sheets

GAS CIRCUIT BREAKER

BACKGROUND OF THE INVENTION

1. [Field of the Invention]

The present invention relates to a gas circuit breaker, particularly to an exhaust structure of a gas circuit breaker for immediately exhausting the high-temperature gas produced at the time of current interruption from the gap between electrodes and improving the breaking performance.

FIGS. 7 and 8 show a conventional gas circuit breaker having an exhaust structure 1. FIG. 7 shows a general view of a breaking portion of the circuit breaker in a closing state and FIG. 8 shows an enlarged view of the breaking portion of the circuit breaker in an open state. A contact comprises a fixed main contact 2 and a moving main contact 3 which mainly ensure the current continuity and a fixed arcing contact 4 and a moving arcing contact 5.

The fixed main contact 2 and fixed arcing contact 4 are connected to each other by a fixed-side support member 6 and moreover, supported by a cylindrical insulating support member 7 or the like; and communicates with the exhaust structure 1 made of metal through an opening 8 provided for the fixed-side support member 6. A fixed-side conductor 9 is electrically connected to the fixed-side support member 6 and the exhaust structure 1 to form a current path between the conductor 9 and a moving-side conductor 10. Moreover, a grounded tank 11 is filled with a dielectric gas 12 such as $SF_6$.

The operation of the gas circuit breaker is described below. In opening the circuit breaker from a closing state to an opening state, the moving main contact 3, the moving arcing contact 5, a puffer cylinder 13, and an insulating blast nozzle 14 made of an insulating material such as polytetrafluoroethylene (hereafter referred to as PTFE) or the like are linearly moved by an operating device 15.

When the opening is performed, the dielectric gas 12 in a space enclosed by the moving buffer cylinder 13 or the like and a fixed piston 16 is compressed and blown to the fixed arcing contact 4 and moving arcing contact 5 through the insulating blast nozzle 14. At the time of current interruption, an arc is generated between the fixed arcing contact 4 and the moving arcing contact 5. However, arc extinction and interelectrode insulation recovery are made by the above described blowing of the gas.

The gas blown at the time of arc extinction is heated by the arc and exhausted to the outside of the nozzle as a high-temperature gas reaching several thousands of degrees. The high-temperature gas has a low gas density and a low insulating performance compared to that at ordinary temperature. Therefore, it is necessary to immediately exhaust the high-temperature gas produced at the time of arc extinction from the gap between the electrodes. Therefore, a structure for exhausting the gas from the opening 8 into the exhaust structure 1 is generally used. The exhaust structure 1 controls the exhaust direction of the high-temperature gas and also provides a space for cooling the high-temperature gas.

Breaking performance relates to the efficiency of exhausting the high-temperature gas into the exhaust structure 1 from the gap between electrodes, that is, the exhaust time efficiency is important. In this case, a ratio of an amount of gas exhausted into the exhaust structure 1 to an amount of high-temperature gas produced between electrodes per unit time is defined as an exhaust time efficiency. To further improve the insulation recovery performance between electrodes, it is particularly important to improve the exhaust time efficiency in the period until a transient recovery voltage is applied between the electrodes after a current interruption point since an arc has been generated.

An example in which a portion of an exhaust structure is widened toward the end of the exhaust structure 1 is disclosed in the official gazette of Japanese Patent Publication No. 4-56027/1990 and is a conventional example other than the example described in FIGS. 7 and 8. The same structure may mainly be used to prevent electric field concentration on the end of the exhaust structure 1.

However, as already described, to improve the breaking performance, it is important to immediately exhaust the high-temperature gas produced between the arcing contacts 4 and 5 at the time of arc extinction into the exhaust structure 1, but it is impossible to obtain the breaking-performance improvement effect described in the present invention only by increasing the diameter of an end of the exhaust structure 1.

Moreover, the exhaust structure 1 disclosed in the official gazette of Japanese Patent Publication No. 56027/1992 is not preferable from the viewpoint of breaking performance because the fixed-side conductor joint that protrudes into the exhaust structure 1 limits the high-temperature gas channel in the exhaust structure.

To immediately exhaust high-temperature gas from the gap between the electrodes, it is necessary to quickly send the gas into the exhaust structure 1. In this case, it is necessary to compress the ordinary-temperature gas stored in the exhaust structure 1 or discharge the gas to the outside of the exhaust structure 1. The conventional exhaust structure 1 is made of a metal withstanding high-temperature gas and also serves as a current path, and therefore, becomes a high potential portion. Thus, the maximum diameter of the structure is set to a value equal to or less than the diameter of the metallic portion of the breaking portion so as to decrease the overall dimension of the equipment.

The gas flow cross section of the exhaust tube of the conventional structure has an area equal to or less than $S_1$ when assuming the gas flow cross section of the exhaust tube at the junction face with the fixed-side support member 6 as $S_1$. That is, when assuming the gas flow cross section of the exhaust tube at any position in the exhaust structure 1 as $S_x$, the following expression (mathematical expression 1) is valid over almost all of length of the exhaust structure 1.

$$S_x \leqq S_1 \quad \text{. . . (Mathematical expression 1)}$$

However, from the viewpoint of the exhaust time efficiency greatly influencing the breaking performance, it is not preferable to limit the diameter of the exhaust structure 1. Particularly, when decreasing the diameter of the upstream portion of the exhaust structure 1, the breaking performance may be deteriorated because high-temperature gas is not smoothly exhausted into the exhaust structure 1.

However, to prevent the high-temperature gas produced at the time of current interruption from directly going to the outside, the exhaust structure 1 requires a volume large enough to cool the high-temperature gas. In the case of the exhaust structure 1 of the conventional example shown in FIGS. 7 and 8, the tube length tends to increase in order to secure the volume and as a result, the exhaust structure 1 becomes slender and tubular and thus is increased in size.

Moreover, a slender, tubular exhaust structure 1 lowers the exhaust time efficiency of the gas exhausted from the opening 8. Therefore, as a result, the exhaust structure 1 shown in the conventional example is insufficient for the initial object of immediately exhausting the high-temperature gas produced between the electrodes into the exhaust structure 1 and cooling the gas. When high-temperature gas remains between the electrodes, the insulation recovery performance is deteriorated and a dielectric breakdown may occur between the fixed arcing contact 4 and the moving arcing contact 5, and also, the insulating performance between the contacts 2 and 3 is deteriorated. Particularly, in the case of the structure storing a breaking portion in the insulating cylinder 7 as shown in the conventional example, it is very important to immediately exhaust the high-temperature gas from the gap between the electrodes because the amount of ordinary-temperature gas is small nearby the electrodes.

As described above, it is not preferable that the exhaust structure 1 is present from the viewpoint of the high-temperature gas exhaust time efficiency. However, when the high-temperature gas exhausted from the opening 8 flows to a low-potential portion of the grounded tank 11, the above exhaust structure 1 is necessary because the danger of an earth fault to earth may occur or, though not illustrated, a short circuit between phases may occur in a three-phase-bulk-tank-type circuit breaker which stores three phase breaking portions in the same tank.

SUMMARY OF THE INVENTION

The present invention is made to solve the above problem and its object is to provide a compact gas circuit breaker having good insulation recovery performance between the electrodes and ground and also good interphase insulating performance.

To achieve the above object, a gas circuit breaker of the present invention comprises a grounded tank filled with a dielectric gas, a blast nozzle set in the grounded tank to blow the gas to an arcing contact in order to extinguish the arc produced at the time of current interruption, an opening for exhausting the blown gas, and an exhaust structure provided behind and joined to the opening at a joint to exhaust the gas; in which the exhaust structure at a final portion thereof has an enlarged portion having a gas flow cross section that is larger than that at the joint and in which the start position of the enlarged portion is set at least before a position at ½ of the overall length of the exhaust structure.

Moreover, a gas circuit breaker of the present invention comprises a grounded tank filled with a dielectric gas, a blast nozzle set in the grounded tank to blow the gas to an arcing contact in order to extinguish the arc produced at the time of current interruption, an opening for exhausting the blown gas, and an exhaust structure provided behind and joined to the opening at a joint to exhaust the gas; in which the gas flow cross section of the exhaust tube at the joint is uniformly enlarged backward, away from the opening over the whole region of the exhaust structure.

Furthermore, a gas circuit breaker of the present invention comprises a grounded tank filled with a dielectric gas, a blast nozzle set in the grounded tank to blow the gas to an arcing contact in order to extinguish the arc produced at the time of current interruption, an opening for exhausting the blown gas, and an exhaust structure provided behind and joined to the opening at a joint to exhaust the gas; preferably the exhaust structure has at least one exhaust tube with an exhaust tube at the final portion among the exhaust tubes being an insulator exhaust tube.

Furthermore, a gas circuit breaker of the present invention comprises a grounded tank filled with a dielectric gas, a blast nozzle set in the grounded tank to blow the gas to an arcing contact in order to extinguish the arc produced at the time of current interruption, an opening for exhausting the blown gas, and an exhaust structure provided behind and joined to the opening at a joint to exhaust the gas; in which the exhaust structure has an enlarged portion at the final portion thereof having a gas flow cross section that is larger than the gas flow cross section of the exhaust tube at the joint between the opening and the exhaust structure. Further, preferably, the start position of the enlarged portion is set at least before a position at ½ of the overall length of the exhaust structure, and the central axis of the exhaust structure tilts away from the central axis of the moving part of the gas circuit breaker.

Furthermore, a gas circuit breaker of the present invention comprises a grounded tank filled with a dielectric gas, a blast nozzle set in the grounded tank to blow the gas to an arcing contact in order to extinguish the arc produced at the time of current interruption, an opening for exhausting the blown gas, and an exhaust structure provided behind the opening to exhaust the gas; in which the exhaust structure has an enlarged portion at the final portion of the exhaust structure having a gas flow cross section that is larger than the gas flow cross section of the exhaust tube at the joint between the opening and the exhaust structure wherein the start position of the enlarged portion is set at least before a position at ½ of the overall length of the exhaust structure. Further, preferably the exhaust tube at the final portion of the enlarged portion comprises an insulator exhaust tube.

Furthermore, a gas circuit breaker of the present invention comprises a grounded tank filled with a dielectric gas, a blast nozzle set in the grounded tank to blow the gas to an arcing contact in order to extinguish the arc produced at the time of current interruption, an opening for exhausting the blown gas, and an exhaust structure provided behind the opening to exhaust the gas; in which the exhaust structure has an enlarged portion at a final portion of the exhaust structure having a gas flow cross section that is larger than the gas flow cross section of the exhaust tube at the joint, wherein the start position of the enlarged portion is set at least before a position at ½ of the overall length of the exhaust structure. Further, the enlarged portion is uniformly enlarged toward the final portion of the exhaust structure and the central axis of the exhaust structure is tilted from the central axis of the moving part of the gas circuit breaker. Still further, preferably the exhaust tube at the final portion of the exhaust structure comprises an insulator exhaust tube, that is made of a material containing polytetrafluoroethylene.

According to the present invention, an exhaust structure has an enlarged portion at the final portion of the exhaust structure having a gas flow cross section that is larger than the gas flow cross section of the exhaust tube at the joint between an opening and the exhaust structure and the start position of the enlarged portion is set at least before a position at ½ of the overall length of the exhaust structure. Moreover, the enlarged portion is uniformly enlarged toward the rear of the exhaust structure. Furthermore, the central axis of the exhaust structure tilts from the central axis of the moving part of the gas circuit breaker. Furthermore, the exhaust structure comprises at least one exhaust tube and the exhaust tube at the final portion of the enlarged portion comprises an insulator exhaust tube made of a material containing polytetrafluoroethylene.

By the present invention, the high-temperature gas produced when the gas is blown to an arcing contact in order to extinguish the arc is immediately exhausted into an exhaust structure. Therefore, it is possible to provide good interelectrode insulation recovery performance.

Moreover, because an exhaust structure can be constituted by a plurality of materials and a plurality of members, it is possible to divide portions of the exhaust structure into those requiring mechanical strength and those requiring no mechanical strength and take this into consideration in the manufacturing process.

Furthermore, because the electric field concentration at end of a metallic exhaust tube, which leads to a problem of this type of exhaust tube, is controlled by forming the final portion with an insulating member, it is possible to secure an exhaust tube volume without increasing the distance to a grounded potential portion of the grounded tank 11 or the like, or the distance between phases. That is, because the high-temperature gas exhausted into the exhaust structure mixes with a lot of ordinary-temperature gas, its cooling is progressed and it is possible to decrease the size of the gas circuit breaker.

BRIEF DESCRIPTION OF THE EMBODIMENT

An embodiment of the present invention is described below by referring to the accompanying drawings.

Figure 1:
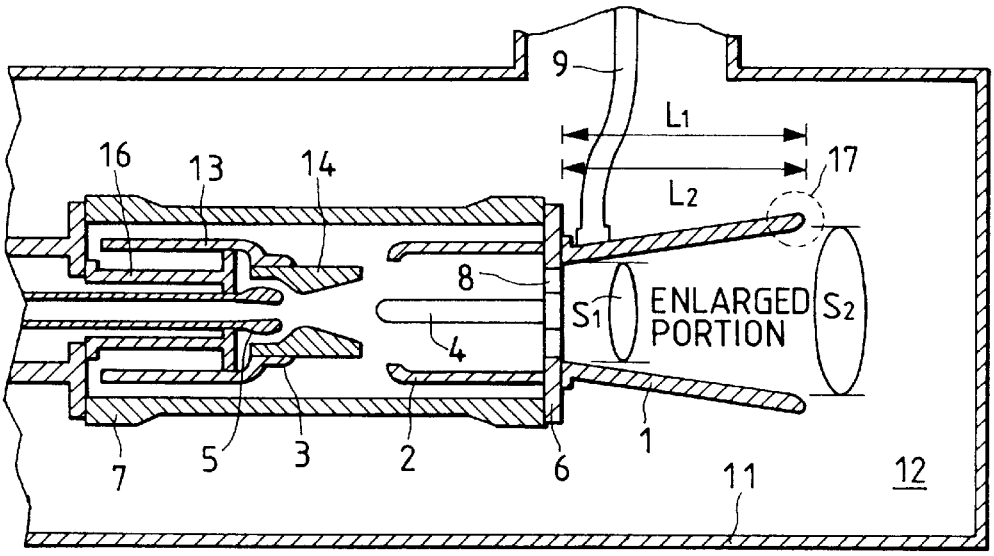
FIG. 1 is an axis-directional sectional view of the gas circuit breaker of an embodiment of the present invention.

FIG. 1 shows the axis-directional cross sectional view of a gas circuit breaker of an embodiment of the present invention. This embodiment is described below is in the open state as shown in FIG. 1. The fixed main contact 2 and the fixed arcing contact 4 are connected to each other by the fixed-side support member 6 having the opening 8, and the contacts are supported by the cylindrical insulating support member 7 from the moving side in the case of this embodiment.

The fixed-side support member 6 connects with the cylindrical exhaust structure 1 at the side facing the moving side and moreover electrically connects with the fixed-side conductor 9 for outputting current to the outside of the grounded tank 11. The exhaust structure 1 is made of metal such as aluminum, stainless steel, iron, or copper. However, when the fixed-side conductor 9 is directly connected with fixed-side support member 6, it is unnecessary to use metal for the exhaust structure 1.

The grounded tank 11 is filled with the dielectric gas 12 such as $SF_6$ and the dielectric gas 12 is exhausted from the insulating blast nozzle 14 through the opening 8 formed in the fixed-side support member 6 and moreover exhausted into the exhaust structure 1.

The exhaust structure 1 has a diameter enlarged portion at the rear (downstream side) of the gas flow from the insulating blast nozzle 14 and a final portion 17 is open to the grounded tank at the maximum diameter. When assuming the gas flow cross section of the exhaust tube at the junction plane with the fixed-side support member 6 in the exhaust structure 1 as $S_1$ and the maximum gas flow cross section of the exhaust tube provided for the rear (downstream side) as $S_2$, the following expression (mathematical expression 2) is effected.

$$S_1<S_2 \quad \text{. . . (Mathematical expression 2)}$$

Moreover, when assuming the gas flow cross section of the exhaust tube at any position in the exhaust structure 1 as $S_x$, the gas flow cross section of the exhaust tube having a diameter enlarged portion can be defined by the following expression (mathematical expression 3).

$$S_1<S_x\leqq S_2 \quad \text{. . . (Mathematical expression 3)}$$

The gas flow in the embodiment of FIG. 1 at the time of current interruption is described below. The dielectric gas 12 blown toward the arc produced between the arcing contacts 4 and 5 at the time of current interruption is mainly exhausted to the fixed side in the form of a high-temperature gas and is led to the exhaust structure 1 through the opening 8 formed on the fixed-side support member 6. In this case, because the exhaust structure 1 has the relation between the mathematical expressions 2 and 3, the high-temperature gas reaching the opening 8 is immediately diffused into the exhaust structure 1 without staying nearby the opening 8. This reason can also be explained by the following expression (mathematical expression 4) which is an expression for continuation of a compressible fluid. The description is made for a steady flow for simplification.

$$\rho vA=\text{Constant} \quad \text{. . . (Mathematical expression 4)}$$

Where,

ρ: Gas density, v: Flow velocity, A: Gas flow cross section

In the mathematical expression 4, the rise of the gas density ρ in the exhaust structure 1 is not preferable because it means that there is a pressure rise in the exhaust structure 1 in the case of a steady flow. Therefore, a structure in which the gas density ρ lowers in the exhaust structure 1 is preferable from the viewpoint of the exhaust time efficiency. However, because it is not considered that the flow velocity v greatly increases in the exhaust structure 1, enlarging the gas flow cross section A is effective to lower the gas density ρ.

That is, it is possible to say that the exhaust structure 1 having a portion in which a gas flow cross section of the exhaust tube is enlarged is a structure having a high exhaust time efficiency, that is, a structure capable of immediately exhausting high-temperature gas into the exhaust structure 1 from the gap between the electrodes. As shown in FIG. 1, the structure in which the gas flow cross section of the exhaust structure 1 is uniformly enlarged toward the rear (downstream direction) is further excellent for the exhaust time efficiency because there is no minimum portion of the gas flow cross section of the exhaust tube.

As described above, it is clear that enlargement of the gas flow cross section of the exhaust tube contributes to improvement of the breaking performance. Moreover, it is important to form the enlarged portion of the gas flow cross section of exhaust tube as forward front (upstream side) as possible. It is already described that, to efficiently exhaust the high-temperature gas produced between the electrodes into the exhaust structure 1, it is necessary to compress the ordinary-temperature gas in the exhaust structure 1 or to discharge the gas to the outside of the exhaust structure 1.

This shows the necessity for front gas to move backward (toward downstream side) or the necessity for mobility of the gas only in the case of the gas in the exhaust structure 1. The mobility of the gas in the exhaust structure 1 depends on the enlarged portion of the gas flow cross section of the exhaust tube. As the exhaust tube length corresponding to the enlarged portion increases, backward movement of the gas present at the front (upstream side) of the enlarged portion is also accelerated.

Though it is ideal to provide the enlarged portion of the gas flow cross section of exhaust tube farther upstream side of the exhaust structure 1 as shown in FIG. 1, this is not always possible from the viewpoint of manufacturing. However, when considering the degree for the mobility of the gas in the exhaust structure 1 to show an effect for the upstream side, it is preferable to provide the enlarged portion of the gas flow cross section of exhaust tube on the upstream side of a position at at least ½ of the overall length of the exhaust tube structure portion. This is because compression of the ordinary-temperature gas in the exhaust structure 1 is remarkably observed at a position on the downstream side of approx. ½ of the overall length of the exhaust tube structure. This observation is made as a result of analyzing the gas flow in the exhaust structure 1 of the conventional example. That is, when assuming the overall length of the exhaust tube structure as $L_1$ and the exhaust tube length corresponding to the enlarged portion of the gas flow cross section of the exhaust tube as $L_2$, and, when the downstream side of the start position of the exhaust tube enlarged portion entirely meets the expression (mathematical expression 3), the relation of the expression (mathematical expression 5) is effected.

$$L_1 \leqq L_2 \times 2 \quad \text{. . . (Mathematical expression 5)}$$

Figure 2:
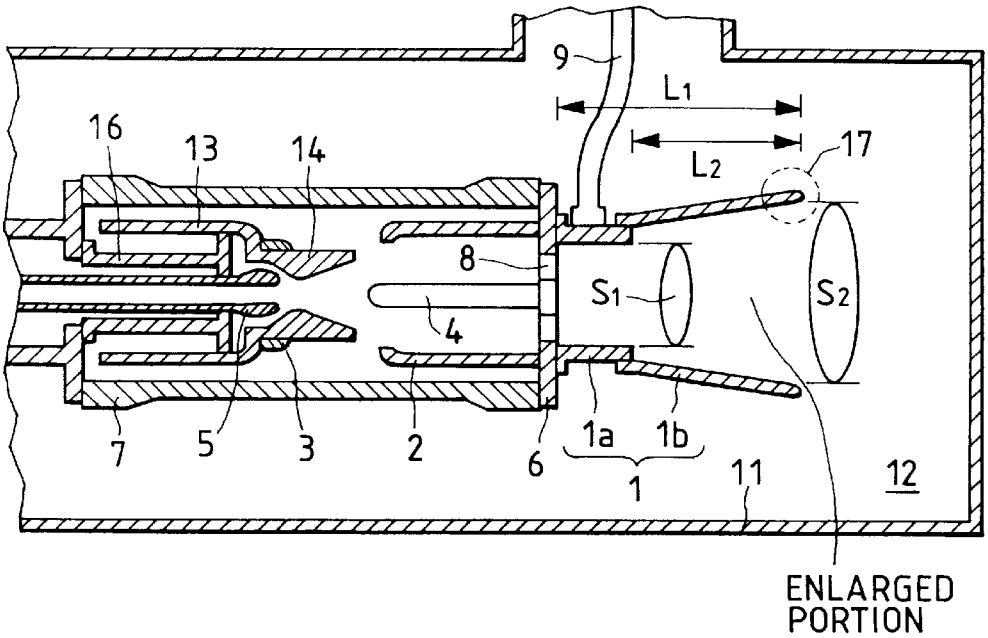
FIG. 2 is an axis-directional sectional view of the gas circuit breaker of another embodiment of the present invention in which an exhaust structure comprises a plurality of tubes.

FIG. 2 shows the axis-directional cross section of the gas circuit breaker of another embodiment of the present invention in which an exhaust structure comprises a plurality of tubes such as two tubes. A second exhaust structure 1*b* communicates with the downstream side of a first exhaust structure 1*a*. In this case, the fixed-side conductor 9 for outputting the current is connected to the first exhaust structure 1*a* to also function as a current supply. Therefore, the first exhaust structure 1*a* requires a certain strength because it structurally supports the fixed-side conductor 9. Moreover, when using a method of directly connecting the fixed-side conductor 9 to the fixed-side support member 6, it is unnecessary for the first exhaust structure 1*a* to function as a current supply and the requirement for the strength of the portion 1*a* is not as critical.

However, the second exhaust structure 1*b* mainly functions to provide a space for cooling the high-temperature gas exhausted from the gap between the electrodes. Therefore, the second exhaust structure 1*b* is constructed using a member different in strength and material from the first exhaust structure 1*a*, such as PTFE, which is an insulator. Moreover, the second exhaust structure 1*b* constitutes the enlarged portion of the gas flow cross section of the exhaust tube.

Because the gas density ρ is lowered by enlarging the gas flow cross section A in accordance with the above (mathematical expression 3), it is expected that a gas pressure P at this position lowers. That is, because the pressure in the exhaust tube of the exhaust structure 1 having the enlarged portion of the gas flow cross section of the exhaust tube becomes lower than that of a structure having no enlarged portion, a required strength can also be decreased.

Because the exhaust structure 1 tends to become relatively large as a breaking portion component, application of the above rationalization in the manufacturing process is preferable. Therefore, it is possible to form a structure more economical than the integrated-type exhaust structure 1 shown in FIG. 1. In the case of the example shown in FIG. 2, the first exhaust structure 1*a* does not have an gas flow cross section portion as a result of considering the manufacturing process. However, a high exhaust time efficiency is secured by minimizing the length of the first exhaust structure 1*a*.

Figure 3:
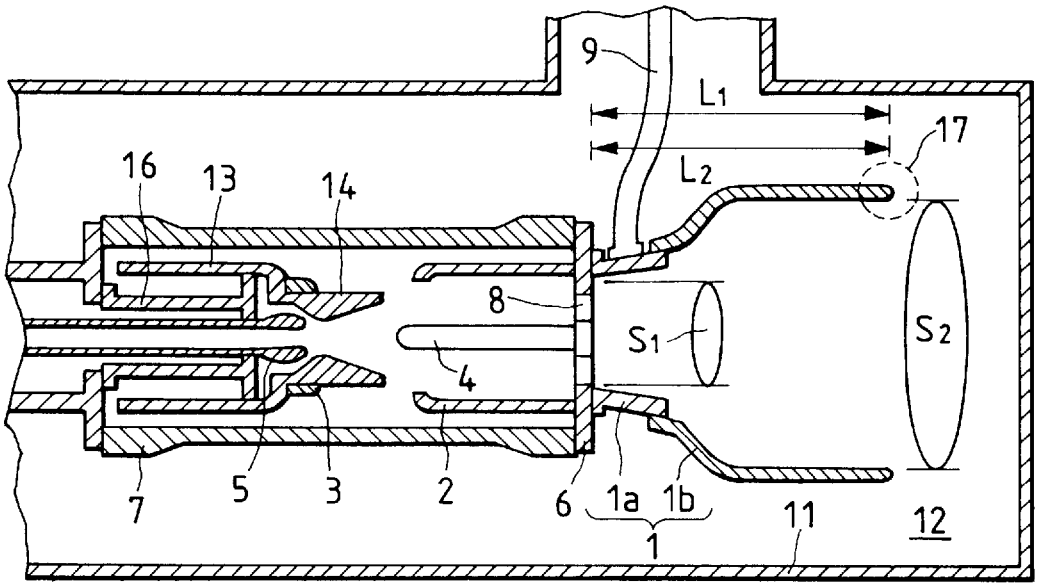
FIG. 3 is an axis-directional sectional view of the gas circuit breaker of still another embodiment of the present invention in which a part of an exhaust structure comprises an insulting exhaust tube.

FIG. 3 shows the axis-directional cross sectional view of the gas circuit breaker of still another embodiment of the present invention in which the second exhaust structure 1*b* of the exhaust structure 1 (comprising a plurality of tubes as shown in FIG. 2) is made of an insulator. Because the size ratio of the exhaust structure 1 to the whole equipment is not small, it is preferable to decrease the overall length of the exhaust structure 1 when downsizing the equipment.

As a result, at the time of current interruption, the gas around the final portion 17 of the exhaust structure 1 may have a high temperature and a low density compared to those at ordinary temperatures until the gas exhausted into the exhaust structure 1 from the gap between the electrodes is cooled. However, when the final portion 17 of the exhaust structure 1 is relatively close to a ground potential portion of the grounded tank 11 or the like, concentration of the field intensities (hereafter referred to as the electric field concentration) occurs in the case of the metallic exhaust structure 1 of the conventional example. In this case, it is preferable to prevent the gas density around the electric field concentrated portion from decreasing because the decrease of the gas density directly causes the insulating performance to deteriorate.

Figure 4:
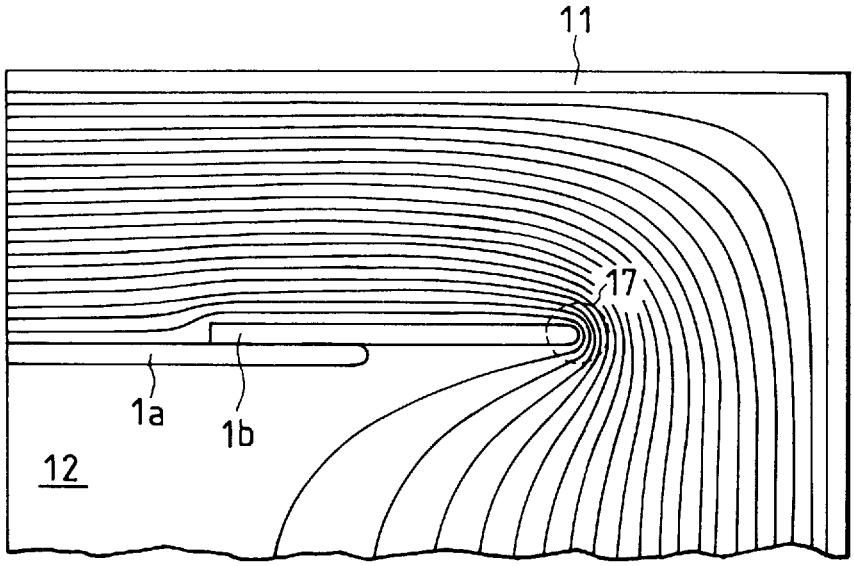
FIG. 4 is an illustration showing equipotential lines nearby the most downstream portion of a metallic exhaust tube.
Figure 5:
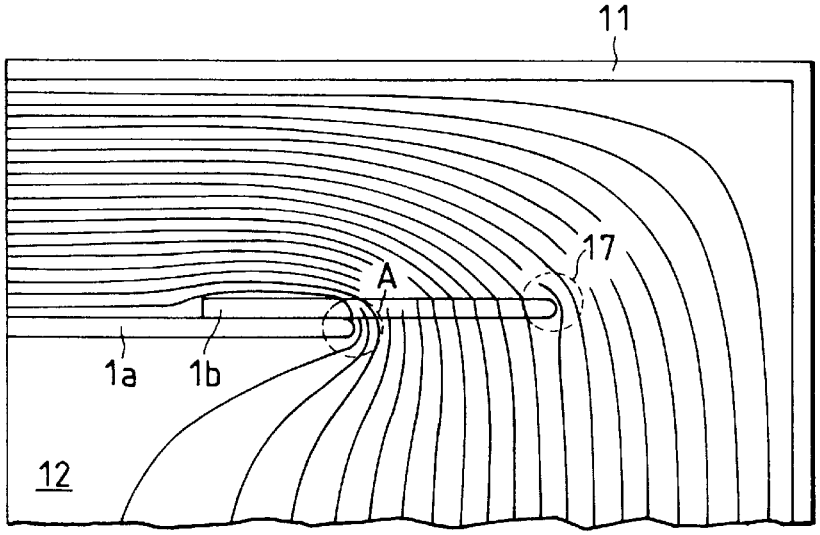
FIG. 5 is an illustration showing equipotential lines nearby the most downstream portion when constituting the most downstream portion of an exhaust tube with an insulator.

FIG. 4 is a diagram resulting from equipotential lines showing a field intensity distribution nearby the final portion 17 of the metallic exhaust structure 1*a* and FIG. 5 is a diagram resulting from equipotential lines showing a field intensity distribution when constituting the exhaust structure 1*b* nearby the final portion 17 with an insulator. In this case, the relation between the exhaust tube length, exhaust tube diameter, and distance from the grounded tank 11 is not changed. Because the analysis of this example is symmetric about the central axis, only the upper half from the central axis is shown.

When constituting the final portion 17 of an exhaust tube with the metallic exhaust structure 1*a* shown in FIG. 4, equipotential lines are concentrated on the exhaust tube at the most-downstream portion 17 and a so-called electric field concentrated portion is formed. However, when constituting a portion around the final portion 17 of an exhaust tube with the insulator as shown in FIG. 5, it is clear from FIG. 4 that the field intensities of the metallic end A and the exhaust tube at the most-downstream portion 17 are decreased and the electric field concentration is controlled.

Because the change in gas density due to the position of the exhaust structure 1 is small compared to the case of the gap between the electrodes of a breaking portion where the arc is generated, though the insulating performance depends on the gas density, control of the electric field concentration by the structure in FIG. 5 is effective for improving the insulating performance. Therefore, forming the periphery of the final portion 17 of the exhaust structure 1 with an insulator to control the electric field concentration is effective for both downsizing the equipment and securing the insulating performance. Moreover, the effect of electric field concentration control is applicable not only to the longitudinal direction of an exhaust tube but also to the radius direction of it.

When forming the enlarged portion of a gas flow cross section of the exhaust tube, particularly the most enlarged portion with an insulator, it is possible to decrease the insulating distance from the grounded tank 11 compared to the case of a metallic exhaust tube. In this case, it can be expected that the breaking performance is improved because the volume of the exhaust structure 1 is increased or the diameter of the grounded tank 11 is decreased.

As described above, when using an insulator exhaust tube for the enlarged portion of the gas flow cross section of the exhaust tube, an improvement in the insulation recovery performance between the electrodes can be expected by enlarging the maximum gas flow cross section S2. Moreover, because the exhaust tube volume can be increased compared to the case of a metallic exhaust tube, cooling of the high-temperature gas in the exhaust structure 1 can be further accelerated and as a result, the equipment can be further downsized.

Because the exhaust structure 1*b* made of an insulator and used for the exhaust structure 1 may be exposed to high-temperature gas for a short time, the portion 1*b* is preferably made of a resin such as PTFE which is also used as a blast nozzle material. Moreover, epoxy resin or the like can be used for a portion such as the final portion 17 of the exhaust structure 1 where the rise in gas temperature is relatively small compared to other portions in the exhaust structure 1.

Figure 6:
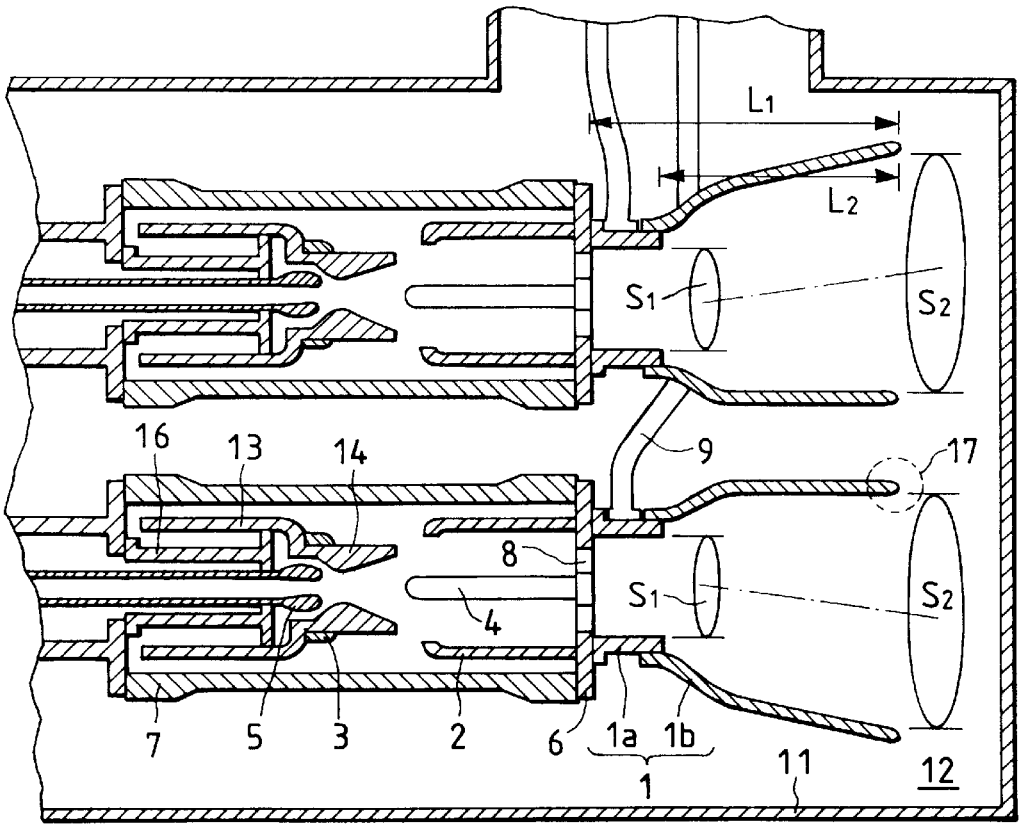
FIG. 6 is an axis-directional sectional view of the three-phase-bulk-tank-type circuit breaker of still another embodiment of the present invention in which the central axis of an exhaust structure is tilted from the central axis of a moving part of a breaking portion.
Figure 7:
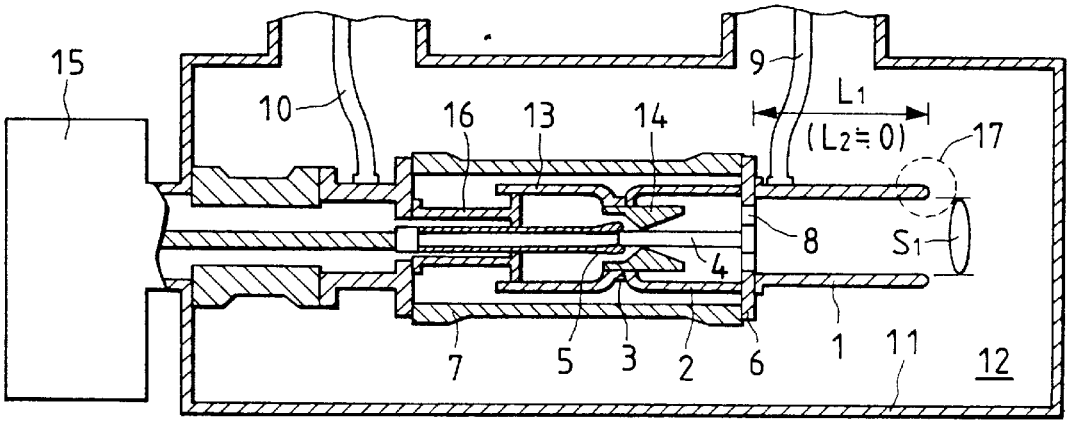
FIG. 7 PRIOR ART
FIG. 7 is an axis-directional sectional view showing the closing state of a gas circuit breaker having a conventional structure.
Figure 8:
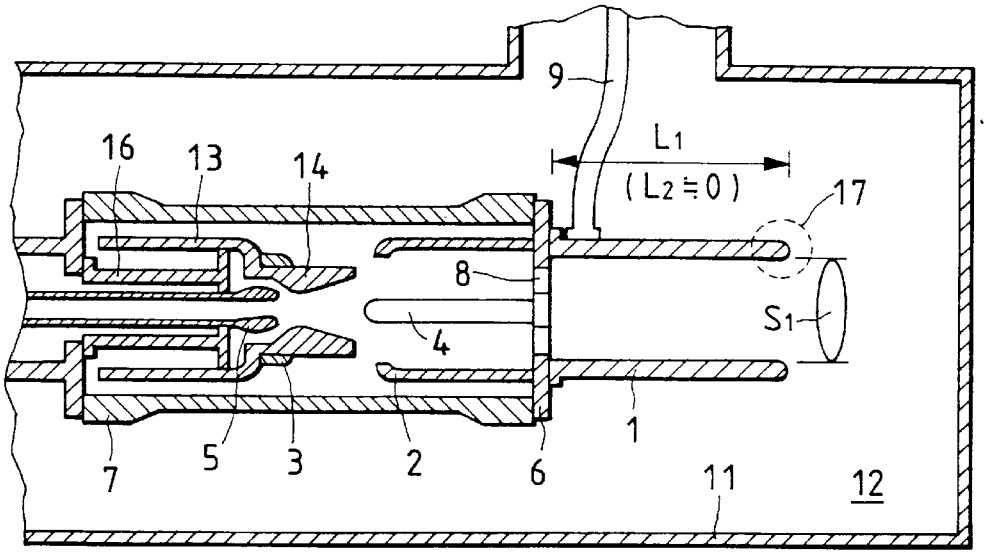
FIG. 8 PRIOR ART
FIG. 8 is an enlarged view of the axis-directional sectional view showing the opening state of the gas circuit breaker having the structure in FIG. 7.

FIG. 6 shows the axis-directional cross sectional view of a three-phase-bulk-tank-type circuit breaker of still another embodiment of the present invention storing three phase breaking portions in the same grounded tank. In this case, only two phase breaking portions are shown among the three phase breaking portions. In the case of the three-phase-bulk-tank-type circuit breaker, the interphase insulating performance with other phases is very important in addition to securing of the ground insulating performance with the grounded tank 11 serving as a low-potential portion. However, it is preferable to prevent an increase in the distance between the phases utmost because such an increase results in an increase of the over all size of the equipment.

In the embodiment of FIG. 6, the central axis of the exhaust structure 1 is tilted away from the central axis of the moving part of the breaking portion to increase the exhaust tube diameter in a direction that the distance between the phases does not greatly influence. As a result, it is possible to improve the exhaust time efficiency while securing the interphase insulating performance. In this case, by using an insulator exhaust tube for the enlarged portion of a gas flow cross section of the exhaust tube, it is possible to realize an exhaust structure 1 having a sufficient volume without enlarging the insulating distance from a grounded tank.

It is above described that a side for mainly exhausting a high-temperature gas from the insulating blast nozzle 14 is used as the fixed side in the case of the present invention. However, even when the fixed side is formed so as to be movable by a plurality of not-illustrated operating mechanisms, the present invention can be applied and the same advantage can be obtained. Moreover, even in the case of a fixed-side support system other than the support system using the insulating cylinder 7 shown in the above embodiment, the importance of immediately exhausting the high-temperature gas into an exhaust structure from the gap between the electrodes remains unchanged. Therefore, the present invention can be applied and the same advantage can be obtained.

[Advantage of the Invention]

According to the present invention, the interelectrode insulation recovery performance is improved because the high-temperature gas produced between the electrodes at the time of current interruption is immediately exhausted into an exhaust structure. Moreover, the high-temperature gas diffused in the exhaust structure is completely cooled by the ordinary-temperature gas in the exhaust structure and thereafter discharged into a tank. Therefore, this is effective to secure the ground and interphase insulating performances of the equipment.

Moreover, by forming the enlarged portion of the exhaust structure with an insulator, it is possible to avoid the problem of electric field concentration at the exhaust tube end of a conventional metallic exhaust structure. Therefore, the equipment can be downsized, that is, a compact and high-performance gas circuit breaker can be obtained.

What is claimed is:

1. A gas circuit breaker comprising a grounded tank filled with a dielectric gas, a fixed arcing contact mounted in said tank, a fixed support member mounted to an outer end of said fixed arcing contact for supporting said fixed arcing contact, a blast nozzle set in said grounded tank to blow said gas to said fixed arcing contact in order to extinguish an arc generated at a time of current interruption, an opening for exhausting said blown gas, and an exhaust structure formed behind said opening in said fixed support member to exhaust said gas; wherein said exhaust structure is joined to said opening at a joint and is provided with an enlarged portion at a final portion of the exhaust structure having a gas flow cross section that is larger than that at the joint and wherein a start position of said enlarged portion is set at least at a position before ½ of an overall length of said exhaust structure with respect to the joint.

2. The gas circuit breaker according to claim 1, wherein said enlarged portion is uniformly enlarged toward the rear of said exhaust structure.

3. The gas circuit breaker according to claim 1, wherein said exhaust structure comprises at least one exhaust tube and said exhaust tube is made of at least one type of material.

4. The gas circuit breaker according to claim 3, wherein said exhaust structure comprises an exhaust tube at the final portion thereof is an insulator exhaust tube.

5. The gas circuit breaker according to claim 4, wherein said insulator exhaust tube is made of a material containing polytetrafluoroethylene.

6. A gas circuit breaker comprising a grounded tank filled with a dielectric gas, a blast nozzle set in said grounded tank to blow said gas to an arcing contact in order to extinguish an arc generated at a time of current interruption, an opening for exhausting said blown gas, and an exhaust structure formed behind said opening to exhaust said gas; wherein said exhaust structure is joined to said opening at a joint and is provided with an enlarged portion at a final portion of the exhaust structure having a gas flow cross section that is larger than that at the joint and wherein a start position of said enlarged portion is set at least at a position before ½ of an overall length of said exhaust structure with respect to the joint, and wherein a central axis of said exhaust structure tilts from a central axis of a moving part of said gas circuit.

7. A gas circuit breaker comprising a grounded tank filled with a dielectric gas, a fixed arcing contact mounted in said tank, a fixed support member mounted to an outer end of said fixed arcing contact for supporting said fixed arcing contact, a blast nozzle set in said grounded tank to blow said gas to said fixed arcing contact in order to extinguish an arc generated at a time of current interruption, an opening in said fixed support member for exhausting said blown gas, and an exhaust structure formed behind said opening having an exhaust tube joined to said opening at a joint to exhaust said gas; wherein a gas flow cross section of the exhaust tube beginning at the joint is uniformly enlarged over an entire region of said exhaust structure and wherein said opening is located at an outer side of the arcing contact at an opposite side to the blast nozzle.

8. A gas circuit breaker comprising a grounded tank filled with a dielectric gas, a fixed arcing contact mounted in said tank, a fixed support member mounted to an outer end of said fixed arcing contact for supporting said fixed arcing contact, a blast nozzle set in said grounded tank to blow said gas to said fixed arcing contact in order to extinguish an arc generated at a time of current interruption, an opening in said fixed support member for exhausting said blown gas, and an exhaust structure formed behind said opening having an exhaust tube joined to said opening at a joint to exhaust said gas; wherein said exhaust structure comprises at least one first exhaust tube joined to said opening and another exhaust tube arranged at a final portion of said exhaust structure that is an insulator exhaust tube.

9. The gas circuit breaker according to claim 8, wherein said insulator exhaust tube is made of a material containing polytetrafluoroethylene.

10. A gas circuit breaker comprising a grounded tank filled with a dielectric gas, a blast nozzle set in said grounded tank to blow said gas to an arcing contact in order to extinguish an arc generated at a time of current interruption, an opening for exhausting said blown gas, and an exhaust structure formed behind said opening to exhaust said gas; wherein said exhaust structure is joined to said opening at a joint and is provided with an enlarged portion at a final portion of the exhaust structure having a gas flow cross section that is larger than that at the joint and wherein a start position of said enlarged portion is set at least at a position before ½ of an overall length of said exhaust structure with respect to the joint, and a central axis of said exhaust structure tilts from a central axis of a moving part of said gas circuit breaker.

11. A gas circuit breaker comprising a grounded tank filled with a dielectric gas, a fixed arcing contact mounted in said tank, a fixed support member mounted to an outer end of said fixed arcing contact for supporting said fired arcing contact, a blast nozzle set in said grounded tank to blow said gas to said fixed arcing contact in order to extinguish an arc generated at a time of current interruption, an opening in said fixed support member for exhausting said blown gas, and an exhaust structure formed behind said opening to exhaust said gas; wherein said exhaust structure is joined to said opening at a joint and is provided with an enlarged portion at a final portion of the exhaust structure having a gas flow cross section that is larger than that at the joint and wherein a start position of said enlarged portion is set at least at a position before ½ of an overall length of said exhaust structure with respect to the joint, and wherein said exhaust structure includes an exhaust tube arranged at a final portion of said enlarged portion that is an insulator exhaust tube.

12. A gas circuit breaker comprising a grounded tank filled with a dielectric gas, a blast nozzle set in said grounded tank to blow said gas to an arcing contact in order to extinguish an arc generated at a time of current interruption, an opening for exhausting said blown gas, and an exhaust structure formed behind said opening to exhaust said gas; wherein said exhaust structure is joined to said opening at a joint and is provided with an enlarged portion at a final portion of the exhaust structure having a gas flow cross section that is larger than that at the joint and wherein a start position of said enlarged portion is set at least at a position before ½ of an overall length of said exhaust structure with respect to the joint, said enlarged portion is uniformly enlarged toward a final portion of said exhaust structure and a central axis of said exhaust structure is tilted from a central axis of a moving part of said gas circuit breaker, and said exhaust structure has an exhaust tube arranged at a final portion of said enlarged portion that is an insulator exhaust tube, and further said insulator exhaust tube is made of a material containing polytetrafluoroethylene.

* * * * *